US006029558A

United States Patent [19]

Stevens et al.

[11] Patent Number: 6,029,558

[45] Date of Patent: Feb. 29, 2000

[54] REACTIVE PERSONNEL PROTECTION SYSTEM

[75] Inventors: David J. Stevens; Kirk A. Marchand; Thomas J. Warnagiris, all of San Antonio, Tex.

[73] Assignee: Southwest Research Institute, San Antonio, Tex.

[21] Appl. No.: 08/855,895

[22] Filed: May 12, 1997

[51] Int. Cl.[7] ..... F41H 5/007

[52] U.S. Cl. ..... 89/36.17

[58] Field of Search ..... 89/36.17; 280/735, 280/736

[56] References Cited

U.S. PATENT DOCUMENTS

| | | | |
|---|---|---|---|
| 3,684,309 | 8/1972 | Uchiyamada et al. | 280/150 AB |
| 3,687,213 | 8/1972 | Sato et al. | 180/82 |
| 3,703,702 | 11/1972 | Arai | 340/52 R |
| 3,778,823 | 12/1973 | Sato et al. | 343/7 ED |
| 3,861,710 | 1/1975 | Okubo | 280/150 AB |
| 3,893,368 | 7/1975 | Wales, Jr. | 89/36.17 |
| 4,782,735 | 11/1988 | Mui et al. | 89/36.07 |
| 4,856,436 | 8/1989 | Campbell | 109/1 R |
| 5,012,742 | 5/1991 | Jones | 89/36.17 |
| 5,327,811 | 7/1994 | Price et al. | 89/36.05 |
| 5,370,035 | 12/1994 | Madden, Jr. | 89/36.08 |
| 5,392,686 | 2/1995 | Sankar | 89/36.05 |
| 5,398,185 | 3/1995 | Omura | 364/424.05 |
| 5,435,226 | 7/1995 | McQuilkin | 89/36.02 |
| 5,451,381 | 9/1995 | Kishimoto et al. | 422/305 |
| 5,478,109 | 12/1995 | Faigle et al. | 280/736 |
| 5,483,449 | 1/1996 | Caruso et al. | 280/735 |
| 5,540,461 | 7/1996 | Nitschke et al. | 280/735 |
| 5,578,784 | 11/1996 | Karr et al. | 89/36.17 |
| 5,584,507 | 12/1996 | Khandhadia et al. | 280/743.1 |
| 5,646,613 | 7/1997 | Cho | 280/730.2 |
| 5,790,404 | 8/1998 | Faye et al. | 280/735 |
| 5,792,976 | 8/1998 | Genovese | 89/1.11 |

FOREIGN PATENT DOCUMENTS

| | | | |
|---|---|---|---|
| 2200437 | 8/1988 | United Kingdom | 89/36.17 |

*Primary Examiner*—Stephen M. Johnson
*Attorney, Agent, or Firm*—Jenkens & Gilchrist

[57] ABSTRACT

A counter-terrorism, reactive personnel protection system which detects the presence of a concussive shock wave or ballistic projectile as it approaches a designated personnel target. Before impact, an air bag is rapidly inflated and interposed between the destructive force and the target so as to provide a protective barrier. The air bag is constructed from ultra-high molecular weight polyethylene material, and serves to halt or redirect the detected destructive force and thereby protect the designated target from attack.

9 Claims, 6 Drawing Sheets

REACTIVE PERSONNEL PROTECTION SYSTEM

BACKGROUND OF THE INVENTION

1. Field of the Invention

This invention relates generally to the field of apparatus and methods for shielding the body from hostile gunshot activity or bomb explosions. More particularly, this invention relates to an apparatus and method for the automated introduction of a protective, inflatable shield between the concussive force of a bomb blast or the impact energy of a projectile, and the body of the person at which it is directed.

2. Description of the Related Art

Many different approaches to the protection of personnel from life-threatening attacks exist. Examples of such approaches include bullet-proof glass, concrete and steel building structures, armored cars, bullet-proof jackets, and others. The particular avenue taken depends on whether the person is stationary, located in a vehicle, located within a building, or is required to maintain mobility outside the confines of any specific stationary structure.

Many law enforcement agencies have the designated task of protecting public figures from terroristic attacks. Most often this protection is achieved through some combination of passive personnel armor (e.g., previously mentioned bullet-proof vests, etc.), identification and control of potential sniper vantage points, and passive protection such as shields, bullet-proof glass, armor plates, and other devices mentioned previously. Since public figures often desire unrestricted access to the public and commensurate high visibility, traditional ballistic screens and placement of protective personnel in close proximity are often not practical or effective. Therefore, a need exists for an unobtrusive, reactive device that provides adequate ballistic protection. This need can be satisfied by detecting an incoming pistol or rifle ballistic projectile, discriminating that projectile from other potential airborne particles or objects, and activation/deployment of a protective device, prior to the arrival of the projectile at the designated target.

A search of the prior art did not disclose any patents that read directly on the claims of the instant invention, however, the following U.S. patents were considered related:

| U.S. PAT. NO. | INVENTOR | ISSUE DATE |
|---|---|---|
| 3,861,710 | Okubo | January 21, 1975 |
| 4,856,436 | Campbell | August 15, 1989 |
| 5,327,811 | Price et al. | July 12, 1994 |
| 4,782,735 | Mui et al. | November 8, 1988 |

Okubo discloses a vehicular safety system having an obstacle detector and an impact detector. These detectors are coupled to a single, inflatable air bag which can be deployed by the activity of either detector. One of the detectors is a Doppler radar for predicting collision with the vehicle, and the other senses impact at the moment it occurs between the vehicle and another object. The air bag is incrementally inflated by signals emanating from either of these detectors, being interposed between the occupants of the vehicle and destructive interior vehicle surfaces.

Campbell discloses an invention to automatically cover electronic equipment for protection from automatic sprinkler systems and other sources of water during the activation of a fire alarm. The cover is deployed by the automatic expansion of spring-loaded telescopic arms which respond to a manual or electronic alarm signal. The cover can be manually reset by rotating and compressing the telescopic arm system to replace the cover into its enclosure. The object of this invention is to protect expensive equipment from fire, smoke, and water damage resulting from fire in the immediate vicinity of the equipment.

Price et al. describes an adaptable bullet-proof vest which makes use of SPECTRA® materials components. The body armor vest consists of several pieces of SPECTRA SHIELD® material (consisting of resin bonded fibers) sewn into woven ballistic SPECTRA® fiber fabric. This combination of woven and non-woven SPECTRA® components creates increased levels of protection for a bullet-proof vest, while simultaneously reducing weight and bulk.

Finally, Mui et al. speaks to a bullet-proof protection apparatus consisting of a full-length, inflatable body shield which can be carried in a portable fashion. The shield consists of an encased, inflatable mattress which is deployed by manual activation of a pressurized gas source. This invention anticipates the use, storage, and re-use of the mattress.

SUMMARY OF THE INVENTION

Public officials, military personnel, and civilian leaders are often exposed to a wide range of physical threats. While the related devices described in the previous section are somewhat effective in detecting destructive terroristic activity, each approach has its own limitations. The most likely threat areas currently encountered are those provided by high explosives, detonated within a building or at some short distance from a building, and small arms fire (e.g. an assassination attempt). The invention herein described incorporates a combination of systems to produce a robust, unobtrusive, and easily installed apparatus which acts to defeat these threats after detonation of a bomb, or discharge of a weapon.

The present invention is a reactive personnel protection system which acts by detecting the presence of a destructive force or object and interposing a protective shield between personnel under attack and the force in an almost instantaneous fashion. Several embodiments of the invention are provided, namely, detection of an incoming small arms projectile, or detection of a concussive blast triggered by a bomb explosion. In either case, a triggering mechanism is provided to rapidly inflate an air bag fabricated from SPECTRA®, KEVLAR®, or similar materials. This air bag is rapidly inflated and interposed between the projectile or concussive force and the person to be protected so as to either deflect the projectile or reduce the effects of the concussive force.

In the case of projectile detection and protection, a radar-based bullet detection system with anti-jamming electronics is used to detect the presence of an incoming small arms projectile and determine its path of travel. A bi-static radar system is used tech detect the Doppler shift signature of any detected objects to reliably determine the presence of a bullet, and discriminate between the bullet and any other rapidly moving object in the vicinity. Additionally, signal processing circuitry and algorithms are used to help differentiate between projectiles and noise or other extraneous signals to prevent false alarms. Once the presence of a ballistic object is confirmed, a control unit activates a gas generation device, which in turn rapidly inflates an anti-ballistic air bag.

In the case of a concussive blast triggered by a bomb explosion, the detection mechanism consists of blast pressure gauges or other devices which are sensitive to rapid changes in acceleration (if mounted to a physical structure), and/or air pressure (e.g. the concussive wave front which accompanies an explosion). These blast pressure gauges are placed at a suitable distance from, and on a periphery around, the personnel to be protected. Other devices, such as magnetostrictive transducers, ultrasonic transducers, accelerometers, and other mechanical and/or electro-mechanical sensors can also be applied to sense the occurrence of a concussive explosion. Signal analysis hardware is used to discriminate and verify the presence of a concussive blast wave front. Redundant verification is also provided, to minimize the likelihood of accidental deployment. Further, anti-jamming electronics are used to provide immunity to electronic noise which may otherwise render the system inoperable. Of course, such redundant verification and anti-jamming electronic systems are also applied to the aforementioned ballistic object detection system.

In the case of either detection system, any type of destructive force confirmation signal resulting therefrom is used to bring about the rapid inflation of an anti-ballistic air bag. This air bag is specially fabricated from ultra-high molecular weight polyethylene, such as SPECTRA®, KEVLAR®, or similar materials which can be used to redirect or lessen the approach of an unwanted destructive object or force. The overall size of the inflated bag depends upon the desired level of protection and the time needed to deploy the bag. Vents are incorporated into the bag to control stress in the bag material during deployment, and also to determine the length of deployment time. Prior to deployment, the air bag is housed in an unobtrusive container having a metallic base plate, and held in place with a pinching bar. The container has a frangible surface through which the air bag can be rapidly deployed.

A gas generation system (also housed in the container holding the air bag) is used to fill and deploy the anti-ballistic air bag. Multiple air bags and/or multiple generators may also be employed, depending on the particular system protection requirements.

It should be noted that the present invention is distinctly different from existing sniper detection systems, which are designed to locate the source of a ballistic projectile after the target has been hit, so that return fire or other offensive actions can be taken. These systems typically make use of Doppler radar or acoustic technology, and do not incorporate any proactive, protective capabilities. The present invention, however, is designed to detect the presence of the projectile during its flight, and before impact.

Therefore, the reactive personnel protection system of thus present invention makes use of a radar-based bullet detection system, or a concussive blast detection system, which provides an inflation signal to an anti-ballistic air bag interposed between the approach of an unwanted destructive object and the personnel to be protected. The signal denoting approach of a destructive force is analyzed and confirmed to make sure that it is properly differentiated from noise or other extraneous signals which may be present. The detection system further includes anti-jamming circuitry for electronic noise immunity and redundant verification to help prevent spurious activation of the air bag.

DETAILED DESCRIPTION OF THE INVENTION

Figure 1A:
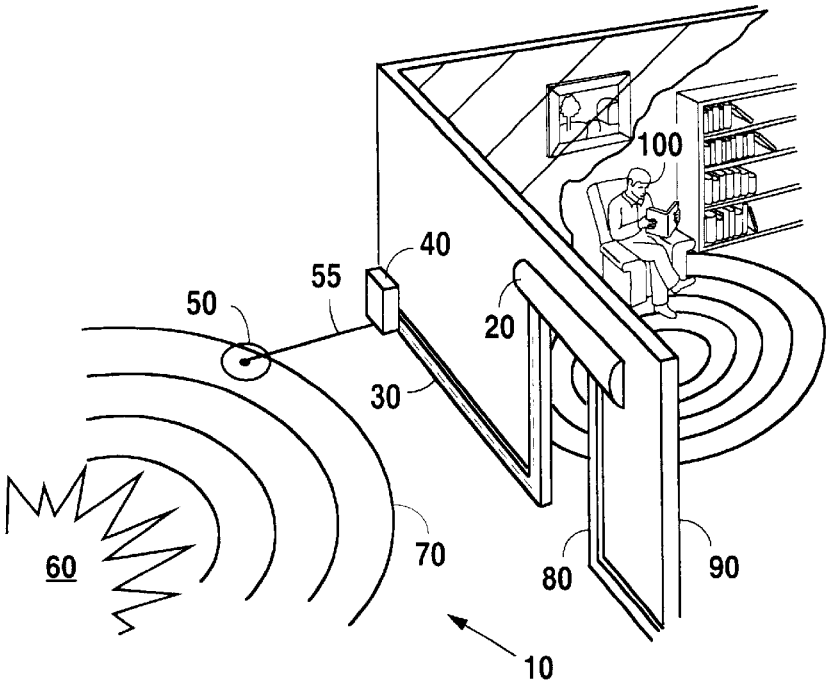
FIG. 1A is a perspective view of the explosion protection embodiment of the present invention before air bag deployment.

Turning now to FIG. 1A, a perspective view of the explosion protection embodiment of the present invention can be seen. This view depicts the state of the apparatus of the present invention prior to detection of a concussive (blast) pressure wave. Person (100) is shown seated in a room (90) having doorway opening (80). Pressure wave sensor (50) is placed at some distance away from air bag enclosure (20) sufficient to ensure that pressure wave (70) emanating from explosion (60) will not reach person (100) before the protective element of reactive personnel protection system (10) can be fully activated.

Figure 1B:
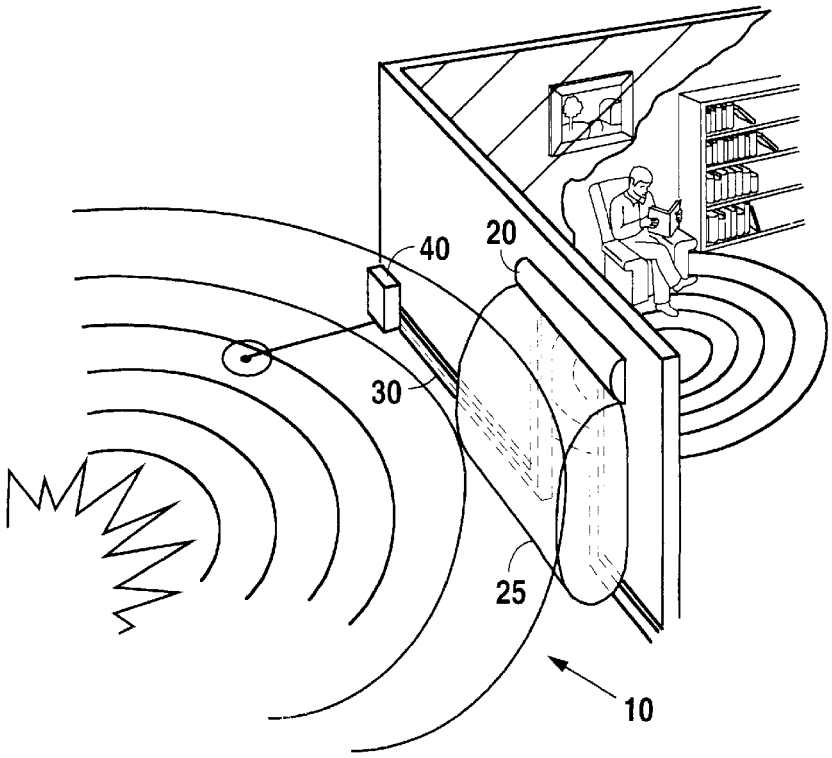
FIG. 1B is a perspective view of the explosion protection embodiment of the present invention after detection of an explosion.

Referring now to FIG. 1B, the deployed condition of the present invention can be seen. Since sound normally travels at a speed of 1,025 ft./sec. at sea level, and it may take air bag (25) approximately 30 msec. to deploy, the minimum distance that sensor (50) should be placed from enclosure (20), which houses air bag (25), is 50 ft. This gives approximately 20 msec. for the control unit (40) to process the signal provided by sensor (50) via sensor output conduit (55), confirm that the signal indicates the presence of a destructive pressure wave (70), and initiate deployment of air bag (25) via trigger output (30).

Figure 2A:
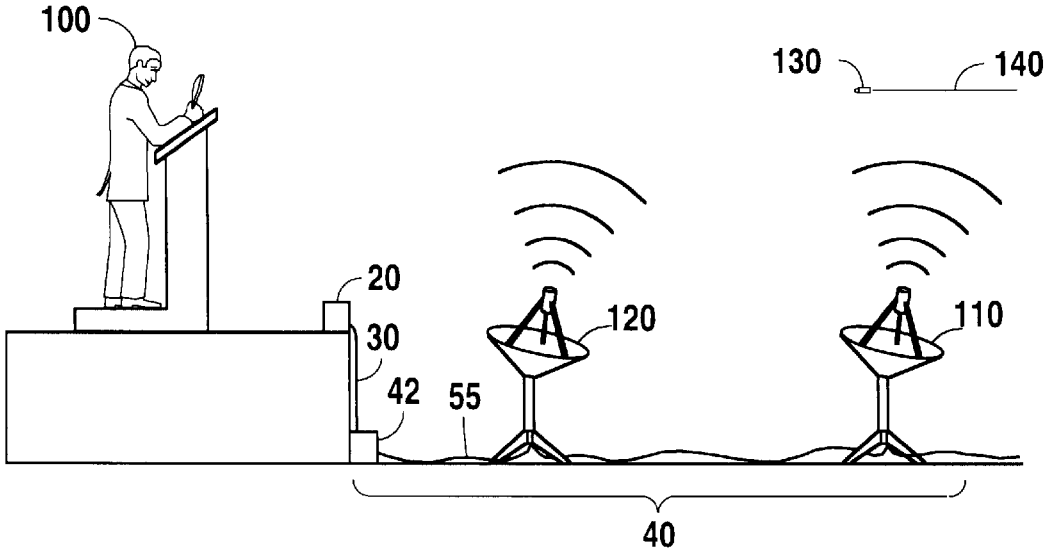
FIG. 2A is a perspective view of the ballistic protection embodiment of the present invention before air bag deployment.

Turning now to FIG. 2A, a perspective view of the ballistic protection embodiment of the present invention before the protective element has been deployed can be seen. It has been determined that the best method for detecting the presence of a bullet (130) is radar technology; acoustic-based systems are less reliable and can be defeated by silencers applied to small arms. Doppler radar systems have been used successfully as velocimeters in ballistic applications, and in general, Doppler radar system perform well in noisy and/or geometrically complex environments. The present invention incorporates a bi-static configuration of Doppler radar in which a separate illuminator or transmitter (110) is located at some distance from passive receiver (120). The sensor output conduit (55) from receiver (120) is monitored by control unit (40) and, after suitable analysis and discrimination, trigger output (30) is activated whenever the presence of bullet (130) is detected and confirmed. Trigger output (30) is sent to enclosure (20), which houses air bag (25) (not shown in this figure).

Figure 2B:
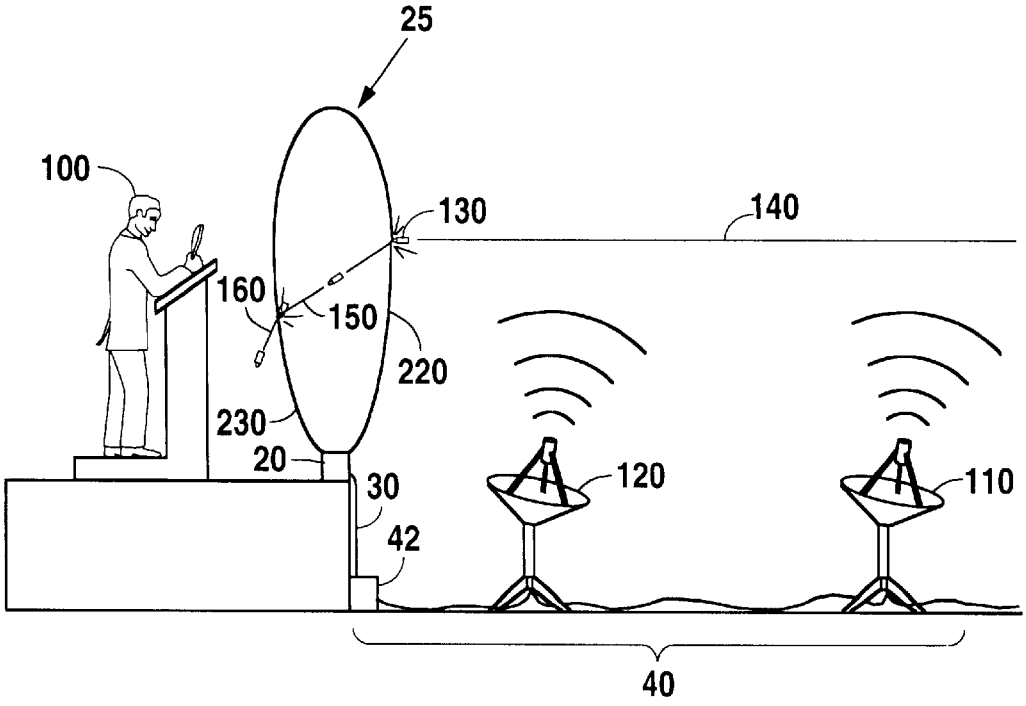
FIG. 2B is a perspective view of the ballistic protection embodiment of the present invention after detection of a ballistic projectile.

Turning now to FIG. 2B, the deployed condition of the ballistic protection embodiment of the present invention can be seen. Initial trajectory (140) of bullet (130) has been detected by receiver (120) and air bag (25) has been deployed from enclosure (20). It should be noted that several enclosures (20), housing multiple air bags (25), can also be employed in this embodiment of the invention. Once control unit (40) has determined initial trajectory (140) of bullet (130), then the appropriate air bag (25) can be deployed via trigger output (30). This figure also illustrates intermediate trajectory (150) of bullet (130), after it is redirected by encountering front surface (220) of air bag (25). Bullet (130) is further redirected by rear surface (230) to follow exit trajectory (160). As mentioned previously, air bag (25) is deployed by control unit (40) so as to interpose a protective shield between the initial trajectory (140) of bullet (130) and person (100).

Lightweight materials, such as DuPont's KEVLAR® and Allied Signal's SPECTRA®, are available as woven fabrics to provide proper anti-ballistic air bag protection. These materials can be sewn or configured in many ways to accommodate ballistic protection applications; in the present invention, the selected material is formed into air bags similar to those found in automobiles, but of larger size and thickness. The strength to weight ratio of these anti-ballistic fabrics are among the highest available, either man-made or natural.

Figure 3A:
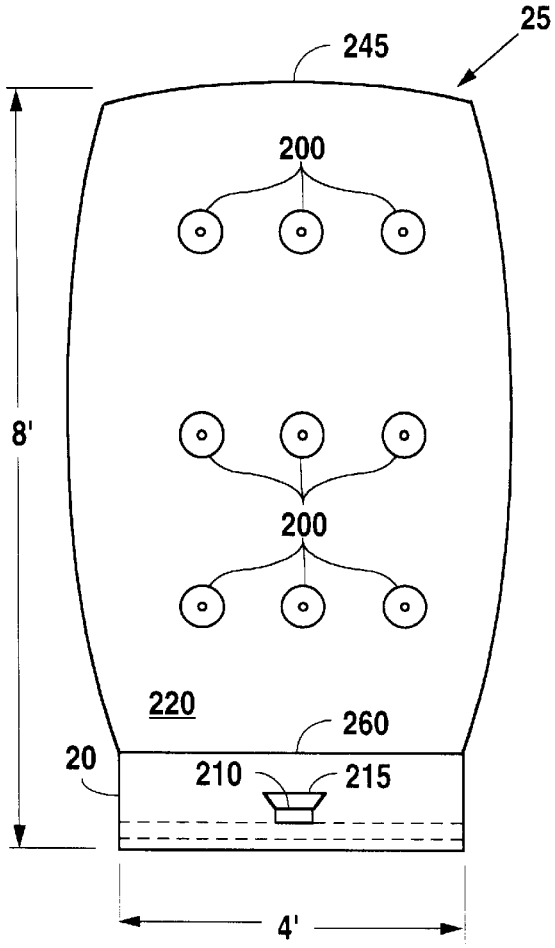
FIG. 3 is a three-view depiction of a deployed air bag.
Figure 3B:
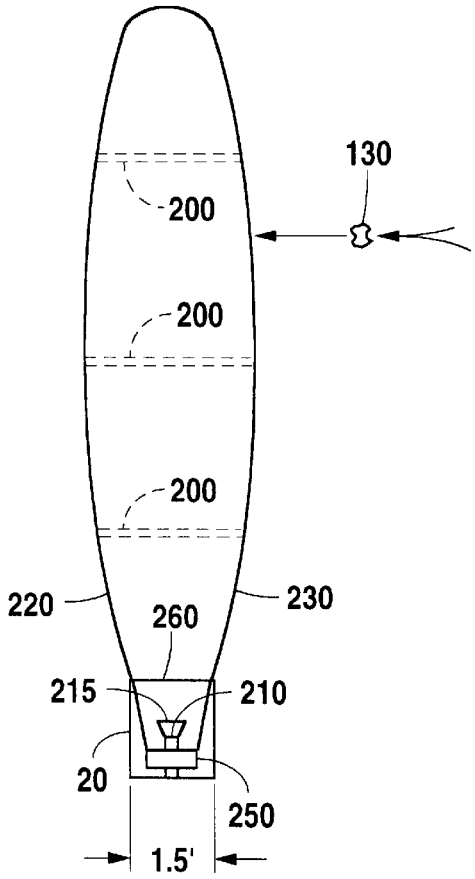
Figure 3C:
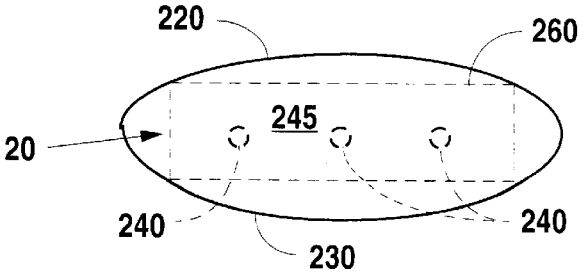

Turning now to FIG. 3, a three-view depiction of the deployed air bag (25) of the present invention can be seen. After detection and confirmation of a concussive shock wave or ballistic projectile, an activation signal is sent to gas generator (210) so that air bag (25) is inflated within approximately 20–30 msec of receipt. Enclosure (20) has frangible upper surface (260) through which air bag (25) emerges when inflated by gas generator (210). Front surface (220), rear surface (230), and top surface (245) of air bag (25) are made from SPECTRA®, KEVLAR®, or other similar ultra-high molecular weight polyethylene fabric. Using such construction results in a type of spaced-plate armor system. That is, for a given level of protection, such a multi-plate system results in a lighter protective element, per unit area, than using a single, equivalent layer of the same material.

The inflation of air bag (25) by way of gas generator (210) is also controlled using vents 9240) and cross-ties (200). Air bag (25) should optimally be configured to remain effectively inflated and in place for at least two seconds.

The effectiveness of the anti-ballistic air bag (25) in stopping a bullet is a function of the thicknesses of the front surface (220) and rear surface (230), as well as the distance between them. The mechanical advantage of this spaced-plate system lies in the fact that the front surface (220) slows, deforms, and re-directs the projectile as it passes through; the slower, tumbling projectile is then either halted or further re-directed by the rear surface (230) of air bag (25).

In the present invention, any material of sufficient strength and toughness to significantly re-direct a ballistic projectile along its initial trajectory can be used to construct the air bag (25). However, the preferred embodiment of air bag (25) is constructed from SPECTRA®, due to its strength, ballistic protection properties, and the ease with which it can be used to fabricate the air bag (25). The thickness of the anti-ballistic fabric can be varied and should be chosen to match a particular threat.

The shape and dimensions of inflated air bag (25) can be modified to meet the required level of protection (e.g. projectile size and velocity), along with area coverage requirements. As shown, the inflated anti-ballistic air bag (25) has a pillow shape, and would be sized to cover a typical doorway if used as illustrated in FIG. 1B. That is, the dimensions would be roughly 4 ft. wide by 8 ft. high by 1½ ft. thick at the widest portion. Air bag (25) is continuously attached to a base plate (250), located near the bottom of enclosure (20), and held in place with a pinching bar (not shown) around the periphery of base plate (250).

The seams of air bag (25) are sewn using SPECTRA® or other, similar fibers, and the structure of air bag (25) is reinforced using cross-ties (200), also of SPECTRA® or similar material so that the air bag (25) deploys vertically, rather than billowing horizontally. The size and position of cross-ties (200) are a function of the size of air bag (25), the required inflation time, and the size of the gas generator (210). Air bag (25) also contains reinforced vents (240) that are sized to control the peak pressure experienced during inflation of air bag (25) and therefore, the peak stress applied to the material used to fabricate air bag (25). Vents (240) located in top surface (245) of air bag (25) also act to provide a downward force which acts against base plate (250) due to vertical jetting of gas expelled through vents (240).

While the system is described as being implemented with SPECTRA® fabric, which is a trademark of the Allied Fibers Division of Allied Signal, Inc., other materials may be used. SPECTRA® fiber is an ultra-high molecular weight polyethylene fiber with high strength and low specific gravity. KEVLAR®, which is a trademark for aramid fiber sold by DuPont, or Dyneema™ can also be used. Also, such materials can be used in combination, such as combining woven ballistic fabric and a non-woven SPECTRA® fiber shield. This method is disclosed in U.S. Pat. No. 5,237,811 issued to Price, et al. Any material which is described as an ultra-high molecular weight polyethylene fiber, or fabric, or any other flexible material of sufficient strength to resist puncture by typical bullet-like projectiles and concussive explosion blasts can be used to implement the air bag of the instant invention.

Gas generator (210) is similar to that found in conventional automobiles, but larger in size and utilizing a faster burning oxidizer component. As illustrated in FIG. 3, a single gas generator (210) is used. However, multiple generators (210) can be used to reduce inflation time and prolong the duration of time during which air bag (25) remains effectively deployed. Gas generator (210) is affixed to base plate (250) and is surrounded by insulation (215) which provides a thermal barrier between gas generator (210), and the nearby base plate (250) and air bag (25).

Figure 4:
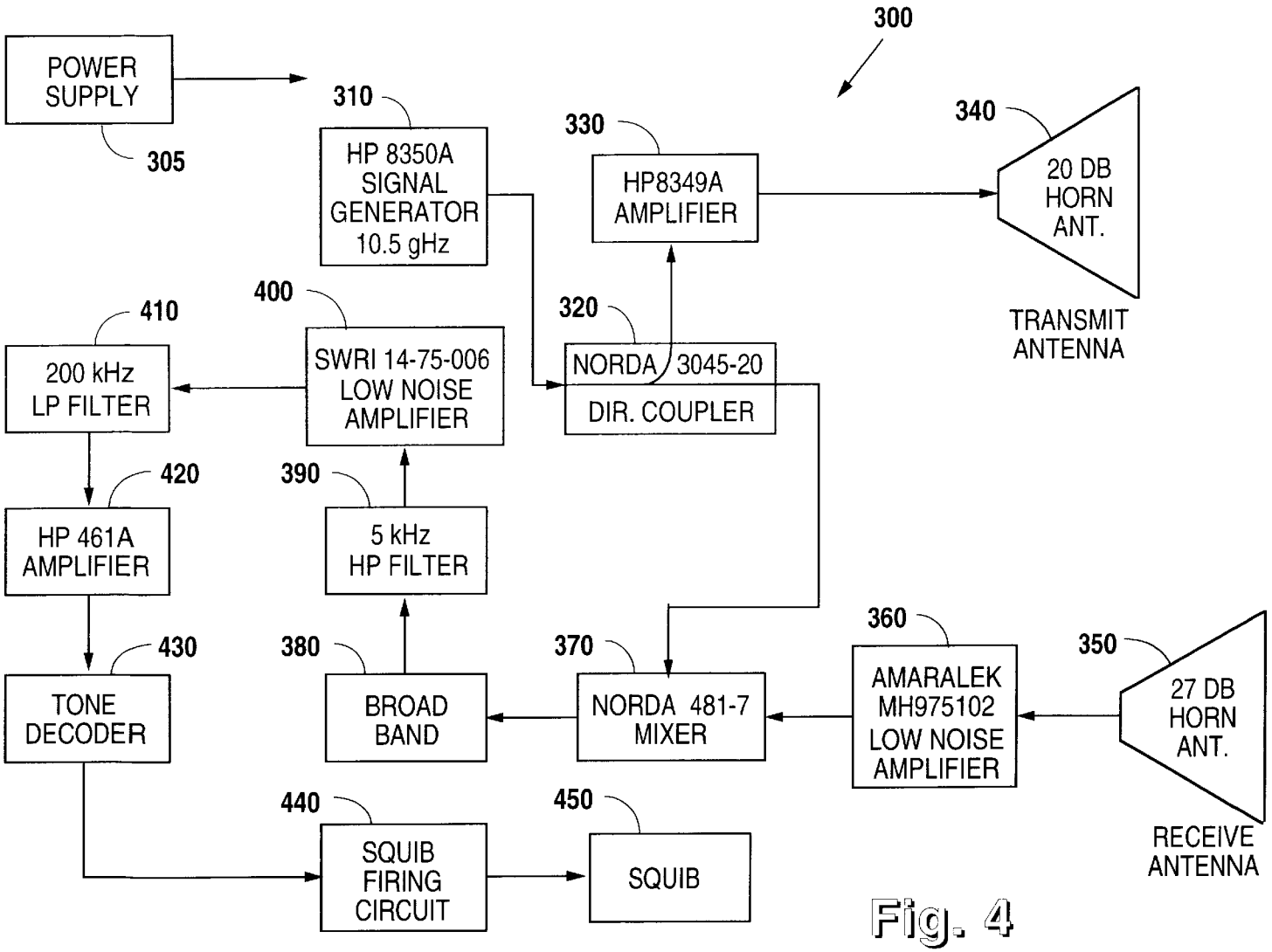
FIG. 4 is a schematic block diagram of a bi-static radar ballistic projectile detection system.

Turning now to FIG. 4, a schematic block diagram of the present invention, using a bi-static radar detection system for ballistic projectiles, can be seen. In this embodiment of the invention, an analog signal processing system is illustrated, however, a RISC processor or other relatively fast digital computer can also be used to process signals from sensory components in the system to reliably detect the presence of a ballistic projectile or concussive wave front.

Power supply (305) is used to supply power to all components employed in the detection, discrimination, and gas generator activation circuits. In this particular embodiment, signal generator (310) supplies a 10.5 GHz signal (normally continuous wave, but modulation for anti-jamming and noise rejection may be added) to directional coupler (320). The generator signal is then amplified by amplifier (330) and passed to transmitting antenna (340) for illumination of incoming objects. The transmitted signal is applied to the general area surrounding personnel to be protected. Transmitting antennae (340) are operated with approximately 100 milliwatts of power at a frequency of 10.5 GHz. Dedicated receiving antenna (350) is passive. The bi-static system, using a separate transmitting antenna (340) and receiving antenna (350), provides greater received signal isolation and greater detection range by reducing receiver signal overload (due to spatial isolation between the respective antennae). Such a system also provides greater flexibility in shaping detection elevation and azimuth coverage. Receiving antenna (350) output is amplified by low noise amplifier (360) and mixed with a sample of the signal provided by signal generator (310) via directional coupler (320) and mixer (370). The resulting signal, introduced into broadband transformer (380) (North Hill Electronics, Inc. model 0016PA, or equivalent), is a Doppler-shifted beat signal. After passing the beat signal through high pass filter (390) (optimally operating at a 3 dB point of 6 kHz, with maximum rejection of 100 dB at 2 kHz), the signal is then amplified via received signal amplifier (400), further filtered by way of low pass filter (410) (optimally acting at a 3 dB point of 200 kHz, maximum rejection of 100 dB at 600 kHz), further amplified using signal amplifier (420), and passed on to tone decoder (430). The low noise amplifier (360) should have as low a noise figure as practical without being overly sensitive to in-band intermodulation. products. The broadband transformer (380) is not essential to system functionality, but is useful for isolating ground-induced noise and further limiting the received signal bandwidth to the bands of interest. The signal amplifier (400) is a low noise (S/N<4 dB) amplifier operating at the doppler frequencies (20 to 70 kHz). Performance is not critical to the operation of the circuit as long as it provides enough gain with the received signal amplifier (420) to trigger the tone decoder.

Tone decoder (430) responds to a Doppler shift produced by predetermined bullet velocities. The shift is determined by the well known equation $\Delta f=2\ Vf_c/C$, where $\Delta f$ is the doppler shift, V is the velocity, $f_c$ is the CW frequency, and C is the speed of light. The tone decoders can be set for a nominal center frequency and bandwidth (bandwith should be limited to 14% of $f_c$). The circuit values illustrated in FIG. 5 produce a response frequency which corresponds to the velocity of a 9 mm bullet. Tone decoder response time varies with the velocity of the bullet plus many other factors. Another detection method requires designing of a recognition algorithm combined with digital signal processing of the sampled doppler waveform. Much better sensitivity and lower false alarms should be possible than those methods using simple tone decoders, which function adequately and provide a lower cost approach. Multiple tone decoders (430) (not shown) with overlapping frequency bands can also be used to detect a range of Doppler shift frequencies so that a corresponding range of ballistic projectile velocities can also be detected.

The ballistic protection embodiment of the present invention may be refined by using one or more transmit and receive antennas to produce a Doppler shift from ballistic projectiles entering a well-defined volume of space. Such antennae combinations would be placed in a specific series of locations optimized for ranging and simultaneously reducing the chance of false alarms by signal sources outside the radar field of view.

To overcome jamming which disables destructive force detection, or deliberate activation of the system through use of electromagnetic signals (either spurious or intended), anti-jamming circuitry is also included in the present invention. Various approaches are available, including signal amplitude and frequency coding, as is well known to those skilled in the art. Such coding may include simple sinusoidal amplitude or frequency modulation, which in turn would produce recognizable side bands on a true Doppler-shifted signal; such side bands would not appear as the result of a jamming signal. More sophisticated coding techniques, including signal doping, can also be used, but should be evaluated in light of possible additional inflation signal output delays, as derived from the resulting decoding constraints.

In other embodiments of the system, a RISC-type control processor, or other fast signal processors as are known in the art, may be used to conduct analysis of signals from receiving antenna (350) after such signals have been suitably filtered and digitized. Software may be used to do simple frequency detection. In addition, algorithms may be used to recognize specific signals for verification of frequency, amplitude, modulation, and/or spectral content of the acquired signal. Redundant hardware and/or processing algorithms can also be used to confirm the presence of a ballistic projectile or concussive wave front, to minimize the likelihood of accidental deployment.

Once the presence of a ballistic projectile has been reliably detected, then the firing circuit (440) is activated. The squib (450) (not shown) is located inside gas generator (210) and is used to ignite the oxidizer therein. The gas generator (or gas generators, since multiple units may be used, depending upon the application) is a Primex 28534-301 (or equivalent) with 68 $ft^3$ free volume and approximately 1 lb of propellant. The generator is initiated with a squib, such as an M-102 Atlas Match squib (or equivalent) typically using a firing signal of 3 amps or more at 12 volts for a duration of 2 ms or longer.

Tone decoder (430) can be constructed from a conventional LM567C tone decoder integrated circuit, or similar device, and is used to detect the presence of certain frequencies to determine the presence of a Doppler-shifted ballistic projectile signal.

Figure 5:
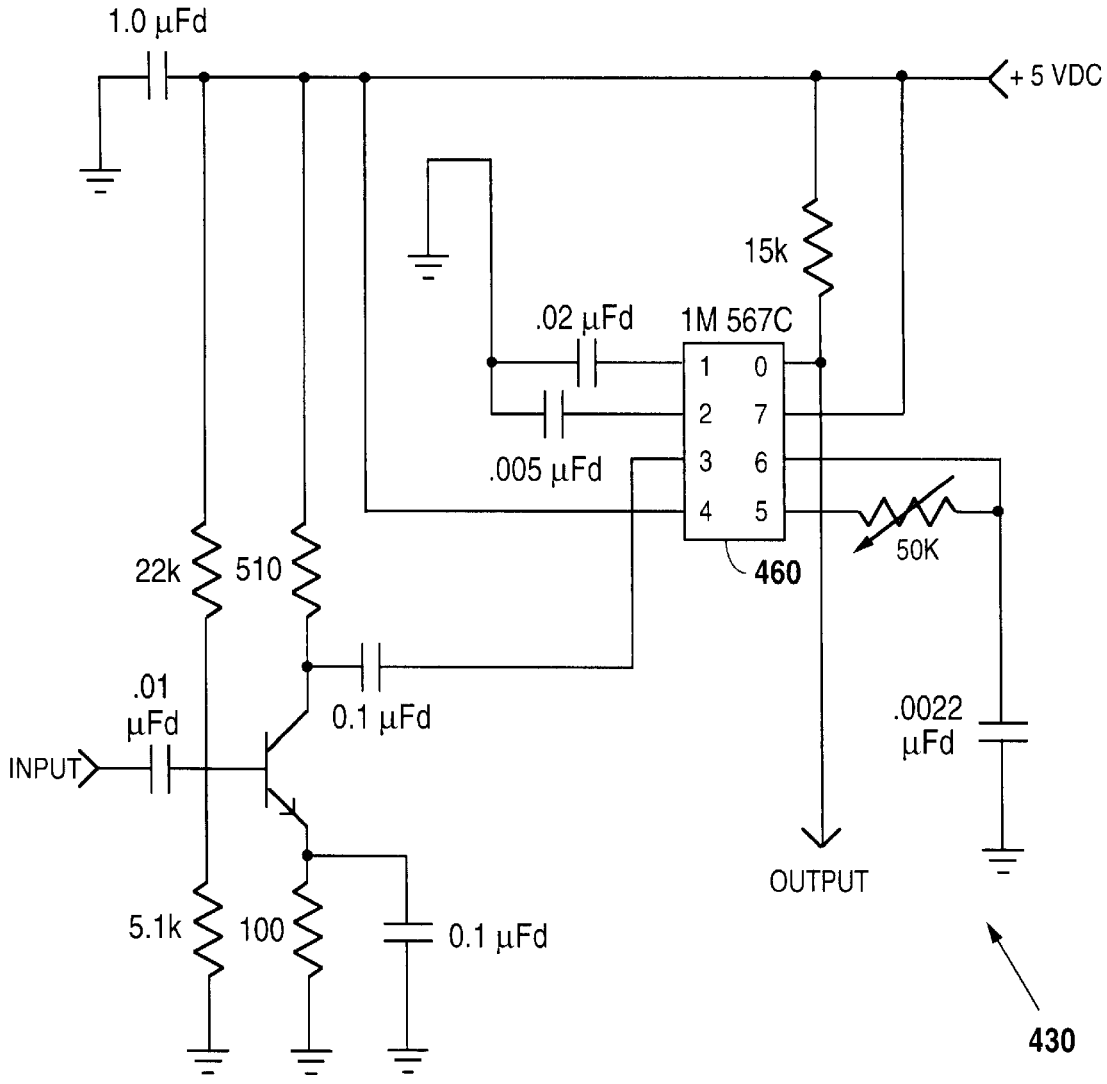
FIG. 5 is a schematic diagram for Doppler-shifted tone detection.

Turning now to FIG. 5, the circuit diagram for tone decoder (430) is illustrated. As can be seen, tone decoder integrated circuit (460) of type LM567C, or similar, is surrounded by conventional components, the particular values of which are illustrated on the diagram. Individual component values are determined by formulas well-known in the art, and the values shown in the figure are typical for detection of a Doppler-shifted frequency generated by a 9 mm bullet. For example, it has been experimentally determined that the range of doppler shift varies from approximately 19 Khz to 26 kHz for a 9 mm bullet travelling at speeds of 900 fps to 1200 fps, respectively. For a 5.56 mm bullet, the shift goes from 64 kHz to 73 kHz for velocities ranging from 3,000 fps to 3,400 fps, respectively. Of course, multiple tone decoders, operating simultaneously, can be used in this particular embodiment of the present invention, any one of which is capable of activating firing circuit (440).

Figure 6:
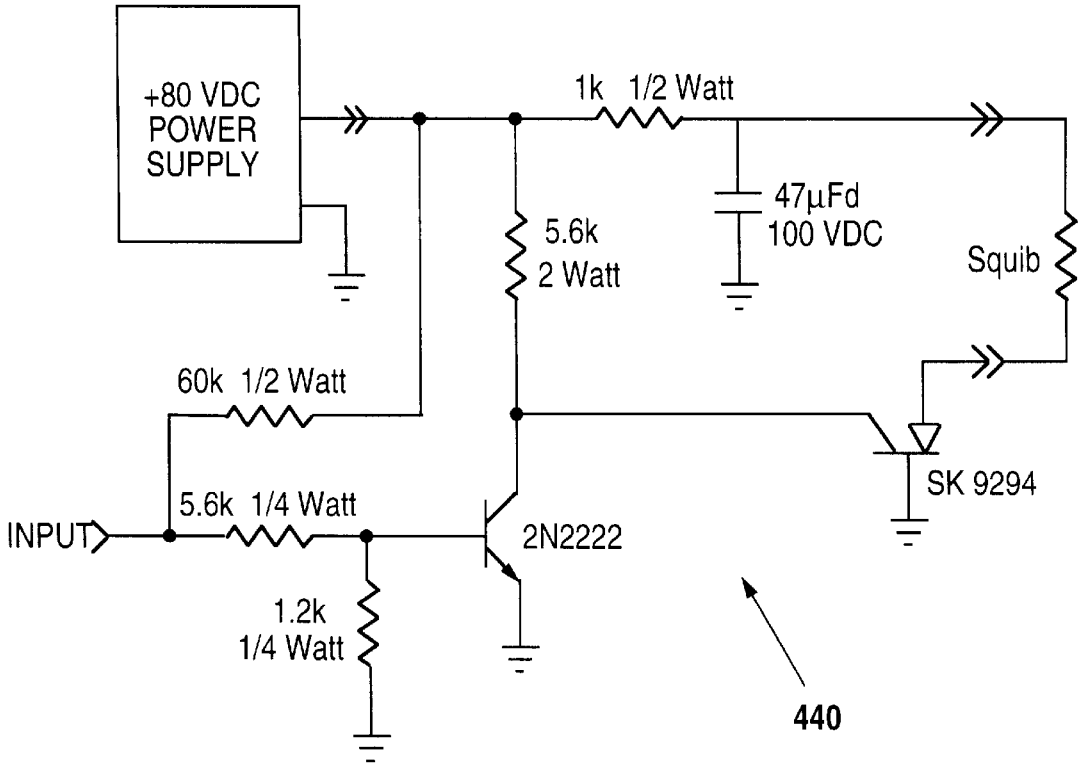
FIG. 6 is a schematic diagram of a gas-generator squib ignition circuit.

Turning now to FIG. 6, a schematic diagram of the gas generator squib ignition circuitry is illustrated, using typical component values well known in the art. Generally, a signal of at least 3 amps at 12 volts must be present for a duration of 2 ms or longer. The propagation delay involved in firing the squib after receiving the validated concussive shock wave or ballistic projectile detection signal is approximately one msec, depending on tone decoder detection time.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A reactive personnel protection system comprising:

a radar-based projectile detection system;

at least one rapidly deployable anti-ballistic air bag, said air bag having a front surface and a rear surface; and a gas-generating system for rapid deployment of said air bag in response to detection of the approach of a projectile in proximity to said person by said detection system, wherein the front surface and the rear surface are adapted to slow and redirect the projectile.

2. The system of claim 1 wherein the rapidly deployable air bag is constructed from polyethylene material.

3. A reactive personnel protection system comprising:

a radar-based projectile detection system, wherein said radar based projectile detection system operates at a frequency of 8–20 Ghz;

at least one rapidly deployable air bag; and a gas-generating system for rapid deployment of said air bag in response to detection of the approach of a projectile in proximity to said person by said detection system.

4. A reactive personnel protection system comprising:

a radar-based projectile detection system, wherein said radar based projectile detection system operates at a frequency of 10.5 Ghz.;

at least one rapidly deployable air bag; and a gas-generating system for rapid deployment of said air bag in response to detection of the approach of a projectile in proximity to said person by said detection system.

5. A reactive personnel protection system comprising:

a radar-based projectile detection system, wherein said radar based projectile detection system has anti-jamming electronics;

at least one rapidly deployable air bag; and a gas-generating system for rapid deployment of said air bag in response to detection of the approach of a projectile in proximity to said person by said detection system.

6. A method to reactively protect personnel from the rapid approach of an object by deployment of an air bag prior to the arrival of the object at the location of said personnel, comprising the steps of:

detecting the approach of said object, wherein said detecting step is accomplished using a radar-based projectile detection system and wherein said object is a ballistic projectile;

discriminating the presence of said object with respect to the presence of electronic noise;

activation of a gas-generation system in response to discrimination of the presence of said object; and deployment of an air bag between said object and said personnel responsive to said activation of said gas-generation system.

7. The method of claim 6, wherein said radar-based projectile detection system operates at a frequency of 8–20 Ghz.

8. The method of claim 6, wherein said radar-based projectile detection system operates at a frequency of 10.5 Ghz.

9. A reactive personnel protection system of a type in which at least one airbag is inflated responsive to detection of a destructive object prior to contact between said object and a person, said system comprising:

a destructive object detection system;

at least one rapidly deployable airbag; and a gas-generating system for rapid deployment of said airbag in response to detection of the approach of said object in proximity to said person by said detection system, wherein said detection system is a radar-based projectile detection system operating at a frequency of 8–20 Ghz and wherein said object is a ballistic projectile.

* * * * *

US006029558C1

(12) EX PARTE REEXAMINATION CERTIFICATE (5714th)

United States Patent
Stevens et al.

(10) Number: US 6,029,558 C1
(45) Certificate Issued: Mar. 20, 2007

(54) REACTIVE PERSONNEL PROTECTION SYSTEM

(75) Inventors: David J. Stevens, San Antonio, TX (US); Kirk A. Marchand, San Antonio, TX (US); Thomas J. Warnagiris, San Antonio, TX (US)

(73) Assignee: Southwest Research Institute, San Antonio, TX (US)

Reexamination Request:
No. 90/006,270, Apr. 24, 2002

Reexamination Certificate for:

| | |
|---|---|
| Patent No.: | **6,029,558** |
| Issued: | **Feb. 29, 2000** |
| Appl. No.: | **08/855,895** |
| Filed: | **May 12, 1997** |

(51) Int. Cl.
*F41H 5/007* (2006.01)

(52) U.S. Cl. ..... 89/36.17
(58) Field of Classification Search ..... None
See application file for complete search history.

(56) References Cited

U.S. PATENT DOCUMENTS

| | | | | |
|---|---|---|---|---|
| 3,684,309 | A | 8/1972 | Uchiyamada et al. | 280/150 AB |
| 3,687,213 | A | 8/1972 | Sato et al. | 180/82 |
| 3,703,702 | A | 11/1972 | Arai | 340/52 R |
| 3,778,823 | A | 12/1973 | Sato et al. | 343/7 ED |
| 3,861,710 | A | 1/1975 | Okubo | 280/150 |
| 3,893,368 | A | 7/1975 | Wales, Jr. | 89/36 R |
| 4,782,735 | A | 11/1988 | Mui et al. | 89/36.07 |
| 4,856,436 | A | 8/1989 | Campbell | 109/1 R |
| 5,012,742 | A | 5/1991 | Jones | 102/418 |
| 5,327,811 | A | 7/1994 | Price et al. | 89/36.05 |
| 5,370,035 | A | 12/1994 | Madden, Jr. | 89/36.08 |
| 5,392,686 | A | 2/1995 | Sankar | 89/36.05 |
| 5,398,185 | A | 3/1995 | Omura | 364/424.05 |
| 5,435,226 | A | 7/1995 | McQuilkin | 89/36.02 |
| 5,451,381 | A | 9/1995 | Kishimoto et al. | 422/305 |
| 5,478,109 | A | 12/1995 | Faigle et al. | 280/736 |
| 5,483,449 | A | 1/1996 | Caruso et al. | 364/424.05 |
| 5,540,461 | A | 7/1996 | Nitschke et al. | 280/735 |
| 5,578,784 | A | 11/1996 | Karr et al. | 89/36.03 |
| 5,584,507 | A | 12/1996 | Khandhadia et al. | 280/743.1 |
| 5,646,613 | A | 7/1997 | Cho | 340/903 |
| 5,739,458 | A | 4/1998 | Girard | 89/36.02 |
| 5,790,404 | A | 8/1998 | Faye et al. | 364/424.05 |
| 5,792,976 | A | 8/1998 | Genovese | 102/293 |
| 6,279,449 | B1 * | 8/2001 | Ladika et al. | 89/36.17 |

FOREIGN PATENT DOCUMENTS

| | | | |
|---|---|---|---|
| GB | 2200437 | 8/1988 | 89/36.17 |

OTHER PUBLICATIONS

PCT/US00/33976 Search Report, Oct. 8, 2001.

* cited by examiner

*Primary Examiner*—David O. Reip

(57) ABSTRACT

A counter-terrorism, reactive personnel protection system which detects the presence of a concussive shock wave or ballistic projectile as it approaches a designated personnel target. Before impact, an air bag is rapidly inflated and interposed between the destructive force and the target so as to provide a protective barrier. The air bag is constructed from ultra-high molecular weight polyethylene material, and serves to halt or redirect the detected destructive force and thereby protect the designated target from attack.

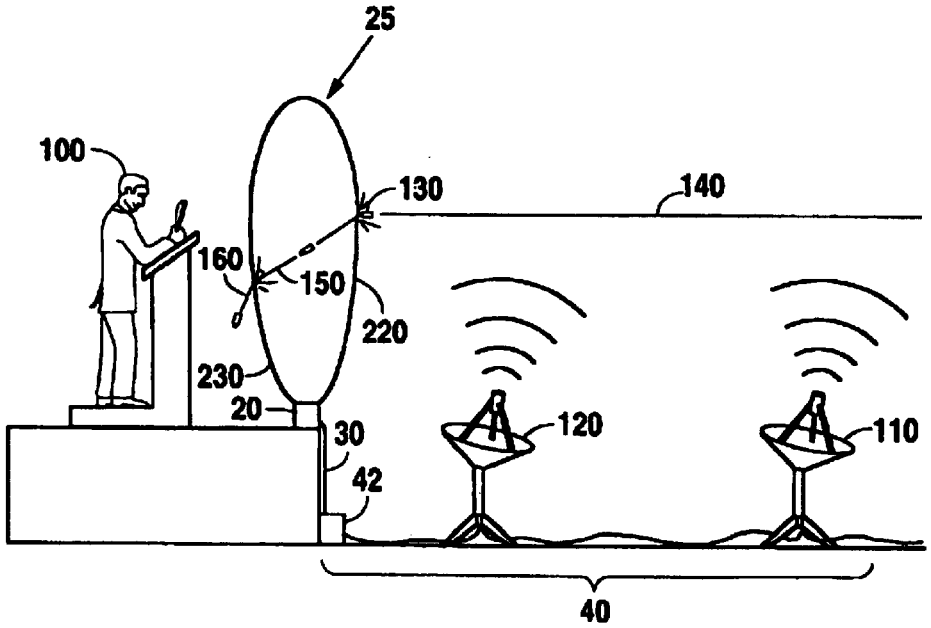

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 6, line 52 through column 7, line 28:

Power supply (305) is used to supply power to all components employed in the detection, discrimination, and gas generator activation circuits. In this particular embodiment, signal generator (310) supplies a 10.5 GHz signal (normally continuous wave, but modulation for anti-jamming and noise rejection may be added) to directional coupler (320). The generator signal is then amplified by amplifier (330) and passed to transmitting antenna (340) for illumination of incoming objects. The transmitted signal is applied to the general area surrounding personnel to be protected. Transmitting antennae (340) are operated with approximately 100 milliwatts of power at a frequency of 10.5 GHz. *More generally, a suitable range of operating frequencies is 8–20 GHz.* Dedicated receiving antenna (350) is passive. The bi-static system, using a separate transmitting antenna (340) and receiving antenna (350), provides greater received signal isolation and greater detection range by reducing receiver signal overload (due to spatial isolation between the respective antennae). Such a system also provides greater flexibility in shaping detection elevation and azimuth coverage. Receiving antenna (350) output is amplified by low noise amplifier (360) and mixed with a sample of the signal provided by signal generator (310) via directional coupler (320) and mixer (370). The resulting signal, introduced into broadband transformer (380) (North Hill Electronics, Inc. model 0016PA, or equivalent), is a Doppler-shifted beat signal. After passing the beat signal through high pass filter (390) (optimally operating at a 3 dB point of 6 kHz, with maximum rejection of 100 dB at 2 kHz), the signal is then amplified via received signal amplifier (400), further filtered by way of low pass filter (410) (optimally acting at a 3 dB point of 200 KHz, maximum rejection of 100 dB at 600 kHz), further amplified using signal amplifier (420), and passed on to tone decoder (430). The low noise amplifier (360) should have as low a noise figure as practical without being overly sensitive to in-band intermodulation. products. The broadband transformer (380) is not essential to system functionality, but is useful for isolating ground-induced noise and further limiting the received signal bandwidth to the bands of interest. The signal amplifier (400) is a low noise (S/N<4 dB) amplifier operating at the doppler frequencies (20 to 70 kHz). Performance is not critical to the operation of the circuit as long as it provides enough gain with the received signal amplifier (420) to trigger the tone decoder.

AS A RESULT OF REEXAMINATION, IT HAS BEEN DETERMINED THAT:

The patentability of claims 3–9 is confirmed.

Claim 1 is determined to be patentable as amended.

Claim 2, dependent on an amended claim, is determined to be patentable.

New claims 10–12 are added and determined to be patentable.

1. A reactive personnel protection system comprising:

a radar-based projectile detection system;

at least one rapidly deployable anti-ballistic air bag, said air bag having a front surface and a rear surface; [and] *wherein the front and rear surfaces are attached by at least one cross-tie;* a gas-generating system for rapid deployment of said air bag in response to detection of the approach of a projectile in proximity to said person by said detection system, wherein the front surface and the rear surface are adapted to slow and redirect the projectile*; and an air bag enclosure for storing the air bag when not deployed.*

*10. The system of claim 1, wherein the air bag is constructed such that it deploys in a pillow shape.*

*11. The system of claim 1, wherein the air bag enclosure is elongated and contains a base plate, and wherein the air bag is continuously attached to the base plate.*

*12. The system of claim 1, wherein the air bag is for use at an entryway and is constructed such that its front and rear surfaces correspond to the dimensions of the entryway.*

* * * * *